United States Patent [19]

Litchfield et al.

[11] Patent Number: 4,525,966

[45] Date of Patent: Jul. 2, 1985

[54] WINDOW SYSTEMS

[75] Inventors: Leon G. Litchfield; Terence Hardy, both of Derby, England

[73] Assignee: L.B. Plastics Limited, Derby, England

[21] Appl. No.: 398,737

[22] Filed: Jul. 16, 1982

[51] Int. Cl.[3] ..... E04B 1/62

[52] U.S. Cl. ..... 52/397; 52/775

[58] Field of Search ..... 52/397, 398, 402, 403, 52/476, 766, 763, 764, 775

[56] References Cited

U.S. PATENT DOCUMENTS

| | | | |
|---|---|---|---|
| 2,830,684 | 4/1958 | Bancroft | 52/397 X |
| 3,501,884 | 3/1970 | DiCesare, Jr. et al. | 52/476 X |
| 4,030,260 | 6/1977 | Sukolics et al. | 52/397 |

FOREIGN PATENT DOCUMENTS

| | | | |
|---|---|---|---|
| 729405 | 3/1966 | Canada | 52/766 |
| 2704808 | 8/1978 | Fed. Rep. of Germany | 52/775 |
| 580219 | 9/1976 | Switzerland | 52/775 |
| 623104 | 5/1981 | Switzerland | 52/397 |

*Primary Examiner*—Kenneth Downey

*Attorney, Agent, or Firm*—W. Thad Adams, III

[57] ABSTRACT

A window construction incorporates a pane or panes of glass retained in a frame by glazing beads inserted between the glass and the frame at the outside of the window and incorporates means for preventing disengagement of the glazing beads other than by breaking the glass. The glazing beads may incorporate oppositely acting retaining formations engageable with at least one co-operating retaining member on the frame, each retaining formation being arranged to be more firmly engaged by movement of the associated bead in a direction to disengage the other formation. In an alternative arrangement the glazing beads may incorporate retaining formations which extend beyond and are retained by the edges of the glass following completion of the glazing process.

7 Claims, 4 Drawing Figures

WINDOW SYSTEMS

This invention relates to window systems and to methods of constructing the same The traditional manner of glazing windows involves the use of glazier's putty or other hardenable compound which is conventionally applied at the outside of the window and sets of hardens so that the glass pane or double-glazed window unit cannot be readily removed. With the advent of window constructions utilising extruded plastics frame components the putty or similar glazing compound is generally replaced by an extruded glazing bead which is inserted between the glass and suitable abutment portions on the window frame. Hitherto the construction has generally been such that the glazing bead can be removed to facilitate re-glazing of the window when required and while this is satisfactory if the bead is located at the inside of the window, it presents a security problem if the bead is external.

In the United Kingdom windows have traditionally been constructed such that the opening lights open outwardly and are glazed from the outside, that is to say, glazier's putty or a similar glazing compound is applied from the outside. In other European countries window conventionally open inwards and are glazed from the inside which produces extra security against removal of the glazing beads to gain unauthorised entry through the window and has made it possible for plastics window frames to be more widely adopted. It has been proposed to construct an outwardly opening window having internal glazing beads but this introduces various complications with regard to the construction of the window frames making them difficult and expensive to produce.

The present invention provides a window construction incorporating a pane or panes of glass retained in a frame by glazing beads inserted between the glass and the frame at the outside of the window and incorporating means for preventing disengagement of the glazing beads other than by breaking the glass.

Preferably the glazing beads incorporate oppositely acting retaining formations engageable with at least one co-operating retaining member on the frame each retaining formation being arranged to be more firmly engaged by movement of the associated bead in a direction to disengage the other formation.

Alternatively the glazing beads may incorporate formations which extend beyond and are retained by the edges of the glass following completion of the glazing process.

The formations may comprise hooked projections adapted for engagement with complimentary formations on said retaining member. Further retaining formations may be provided at the outer edge of the glazing beads for engagement with additional complimentary formations on the window frame.

The glazing beads are preferably constructed from plastics material and of the same uniform cross-section througout their lengths.

The invention also provides a method of glazing a window comprising inserting a glazing unit comprising a pane of glass or a double-glazed assembly in a window frame, engaging glazing beads with retaining formations on the window frame, moving said glazing unit to a position in which one surface thereof engages said glazing beads and at least a portion of the unit extends over said retaining formations, and inserting glazing wedges between the outer face of the glazing unit and a fixed portion of the frame.

Preferably the glazing beads are disposed at the outside of the window and the glazing wedges at the inside. In this way the window is glazed by virture of outer glazing beads but the beads are retained against removal by the glass unit which is moved into its final position after the glazing beads have been inserted and extends over portions thereof to prevent removal of the beads.

Embodiments of the invention will now be described, by way of example only, with reference to the accompanying drawings, in which.

Figure 1:
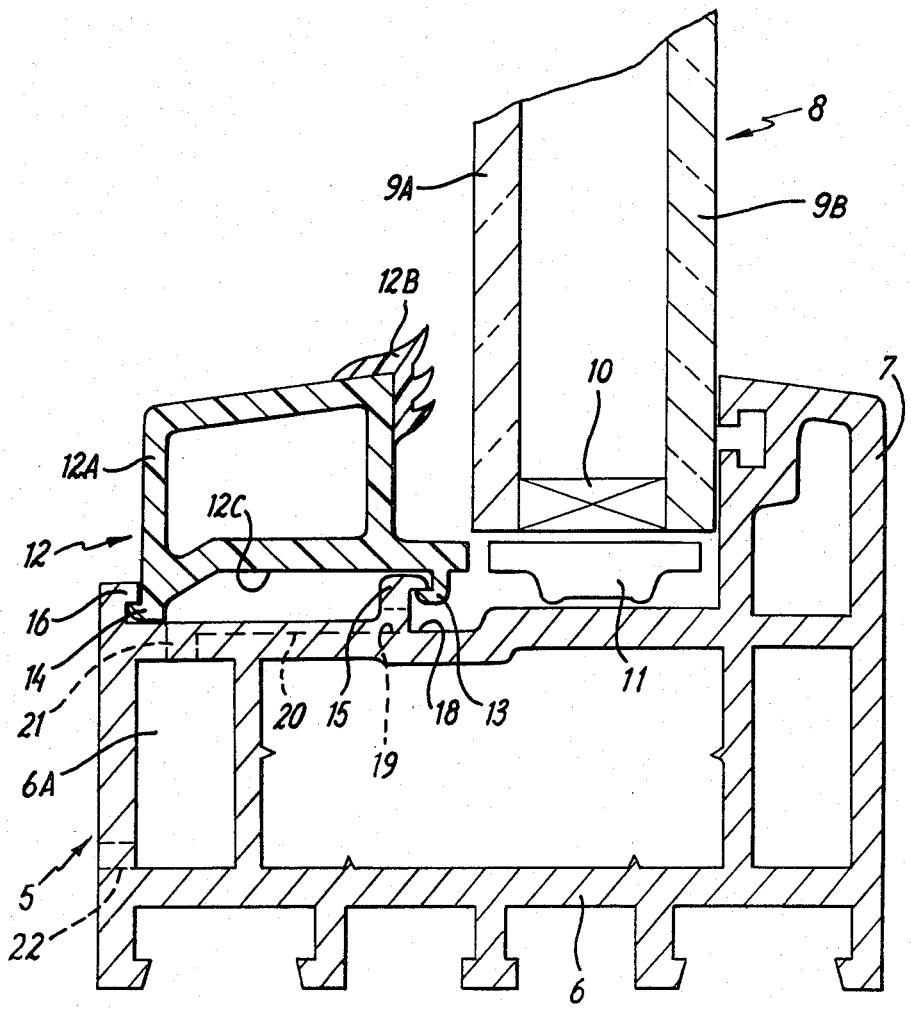
FIG. 1 is a cross-section through part of a window construction according to the invention during a first stage in the glazing process.
Figure 2:
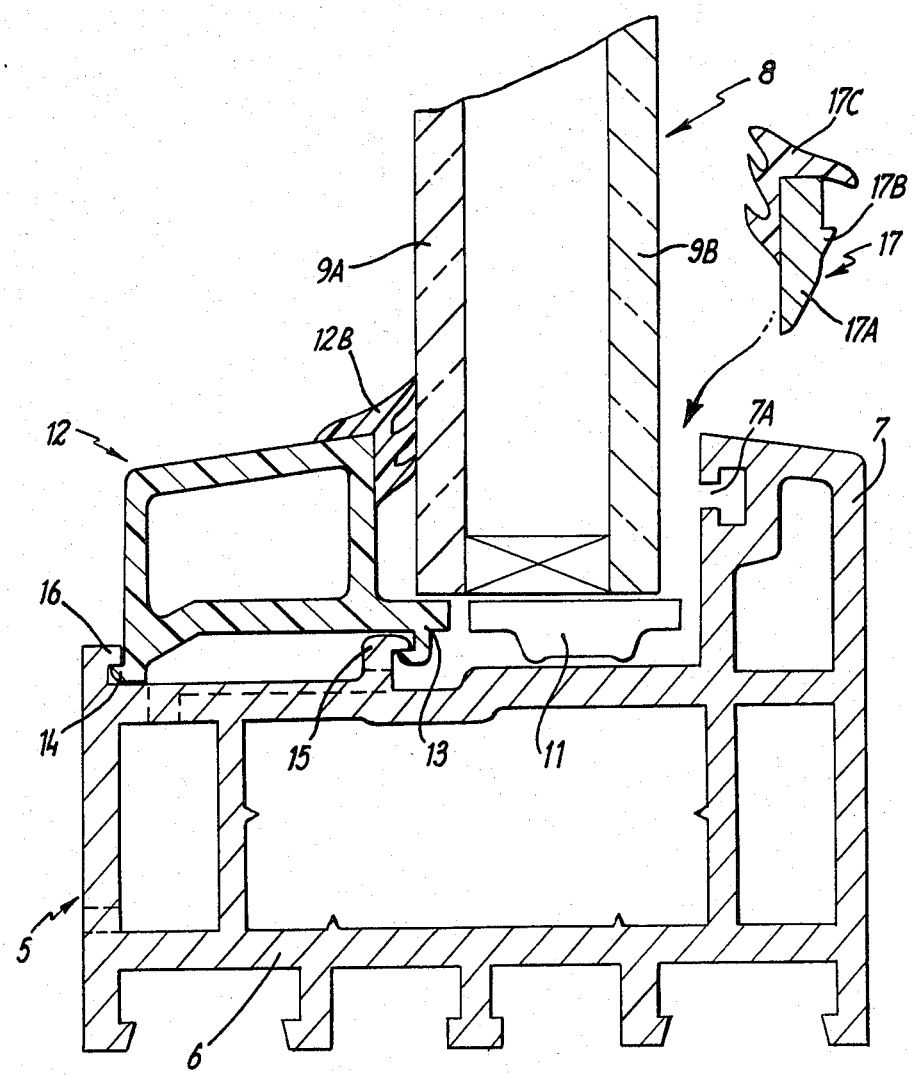
FIG. 2 is a similar cross-section showing a second stage in the glazing process.
Figure 3:
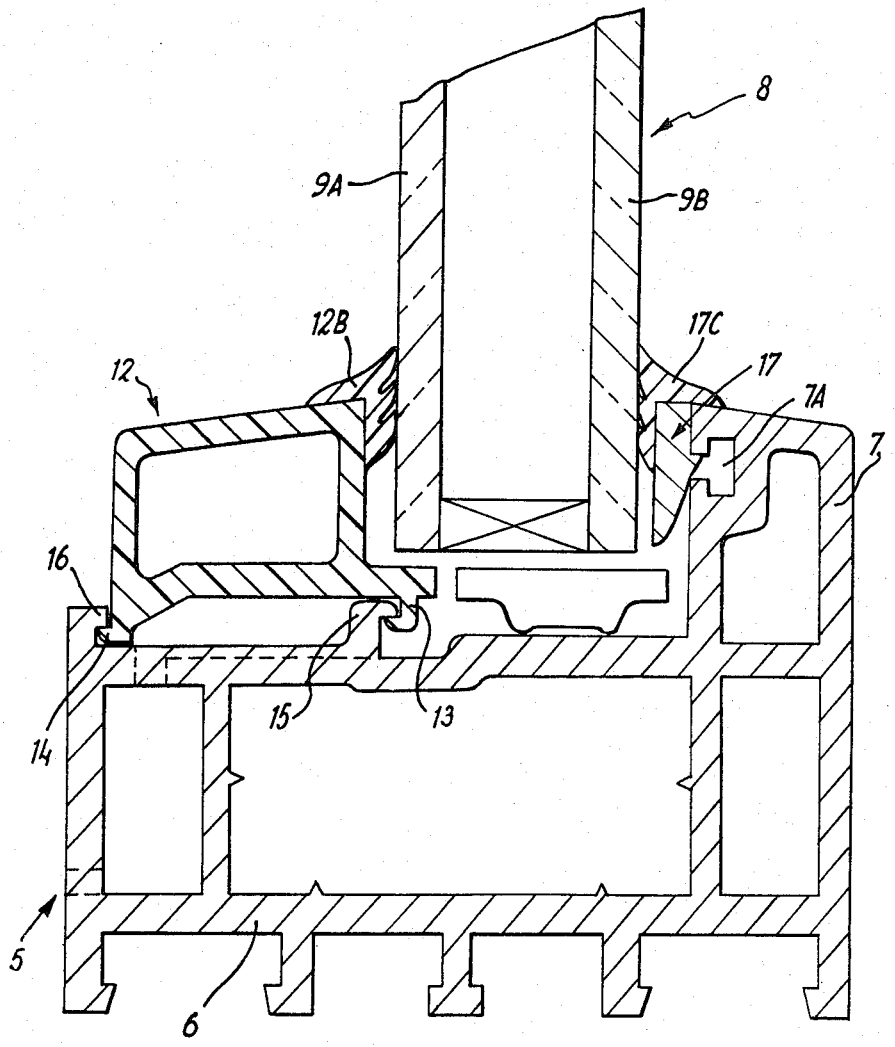
FIG. 3 is a similar cross-section showing the assembly after completion of glazing.

Referring to FIGS. 1 to 3, the assembly includes a main frame constructed from components 5 each having a body portion 6 and an integral projecting shoulder 7 which is directed inwardly of the assembled frame. The shoulders 7 are framed at the side of the frame 5 which is disposed on the inside of the assembled window. The frame is designed to accommodate a double-glazed unit 8 comprising an outer glass pane 9A and an inner glass pane 9B spaced from one another and sealed together around their edges by a sealing assembly 10.

In order to glaze the window the unit 8 is inserted into the frame, butted up to the shoulders 7 and centralized by inserting packing pieces 11 at spaced locations around the unit. Outer glazing beads 12 of extruded plastics construction each comprising a main body portion 12A and a flexible sealing portion 12B are then located at the outer edges of the frame components 5 by engagement of inner and outer retaining lips 13 and 14 with complimentary hooked formations 15 and 16 on the body portions 6 of the components 5. The glazing beads are initially inserted in positions slightly to the right of that shown in FIG. 1 and are then moved to the left, i.e. outwardly, to engage the respective formations and retain the beads against movement relative to the frame in a direction parallel to the plane of the glazing unit, that is upwardly in the case of the lower glazing bead shown in the drawings.

Following insertion of the glazing beads 12 the unit 8 supported on its packing members 11 is moved outwardly, that is to the left in FIG. 1, until it adopts the position shown in FIG. 2 in which the outer surface of the outer pane 9A is in contact with the sealing portions 12B of the glazing beads 12 and the edges of the unit 8 extend over the projections 13 on the glazing beads. Removal of the beads 12 is therefore prevented by abutment of the projections 13 with the unit 8.

Following movement of the unit 8 to the left, glazing wedges 17 are inserted into the gap between the inner face of the unit 8 and the outwardly directed face of the projecting shoulder portion 7 of the frame. The glazing wedges are formed from extruded plastics material and each comprise a rigid body portion 17A provided with a longitudinally extending rib 17B and a flexible sealing portion 17C.

When the glazing wedges are forced into position between the unit 8 and the shoulder 7 of the frame, the ribs 17B locate in longitudinal recesses 7A in the frame and lock the glazing wedges against withdrawal as shown in FIG. 3. The glazing wedges also urge the glazed unit 8 into contact with the glazing beads 12, thereby retaining the unit 8 in the position to which it was moved after insertion of the beads 12 and completing the glazing assembly. As can be seen in FIG. 3 the outer glazing wedges 12 cannot be disengaged due to the complimentary retaining formations 13, 15 and 14, 16. Although slight movement of the beads 12 towards the pane 9A is permitted by the flexible portions 12B of the beads, this movement is insufficient to disengage the retaining formations. Moreover, even if the formations were disengaged, for example by cutting away portions of the flexible members 12B, the beads could not be removed because the formations 13 cannot be withdrawn through the gap between the edges of the glazing unit 8 and the projections 15 on the frame. Likewise the inner glazing wedges cannot be readily removed as they are retained in position by engagement of the ribs 17B in the recesses 7A in the frame. Moreover, the wedges 17 are at the inside of the window and do not therefore present a security problem even if they could be removed.

The frame components incorporate formations serving to permit drainage of moisture which finds its way between the glazing beads 12 or glazing wedges 17 and the glazed unit 8. For this purpose the region of the frame beneath the projections 15 is provided with a longitudinal recess or trough 18 (FIG. 1) connected by holes 19 extending through the projection 15 at spaced intervals to a series of channels 20 formed in the region of the frame behind the glazing beads 12 and in turn connected by holes 21 to a cavity 6A formed within the frame 5. The lower end of this cavity is provided with a series of holes 22 extending through the outer wall of the frame to permit discharge of collected water. Moisture penetrating beyond the seals 12B and 17C therefore passes from the underside of the unit 8 into the trough 18 and by way of the holes 19 channels 20 and holes 21 and 22 is discharged at the outer faces of the frame. The portions of the glazing beads 12 adjacent to the frame between the projections 15 and 16 are recessed at 12C to provide clearance for flow of water through the drainage system.

Figure 4:
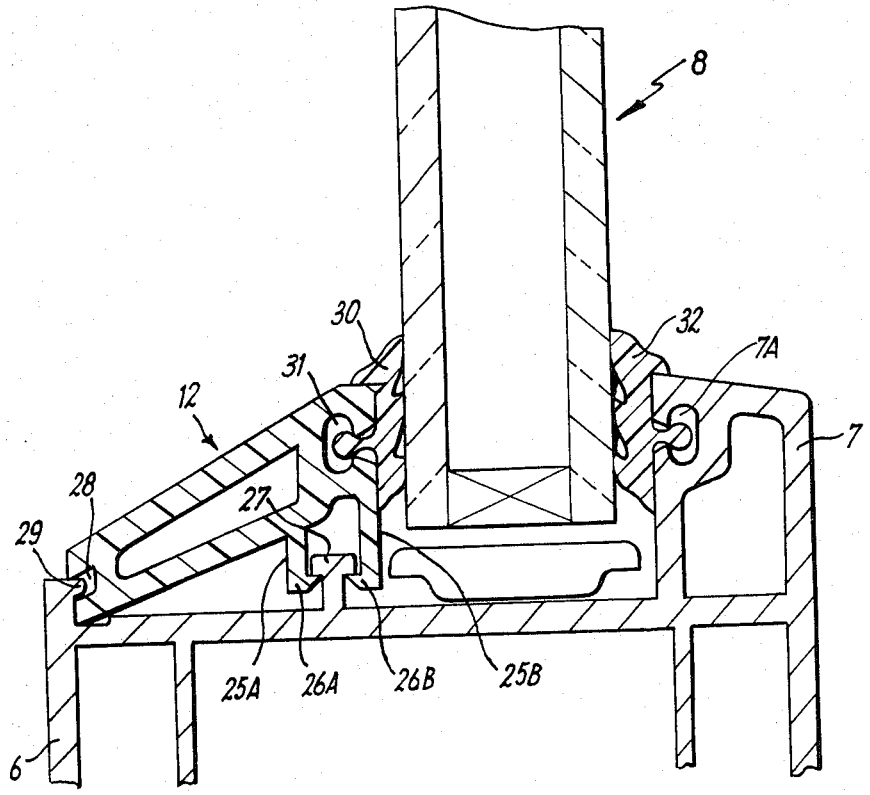
FIG. 4 is a view similar to FIG. 3 showing a modification.

FIG. 4 of the drawings shows a modification in which the inner portions of the glazing beads 12, that is the portions adjacent the glazed unit 8, are provided with retaining formations in the form of spaced parallel projections or ribs 25A, 25B directed towards the body portion 6 of the frame and parallel to the glass. The projections are provided with inwardly directed barbs or hooks 26A, 26B adapted to engage with a retaining member 27 of T-shaped cross-section on the frame 5. The outer edge of the glazing beads are provided with longitudinal grooves 28 engageable with hooked formations 29 formed on the frame 5 and similar to the formations 16 in FIGS. 1 to 3. A flexible sealing strip 30 is engaged in a recess 31 at the inner edge of the glazing bead for abutment with the glazed unit 8.

In use of the arrangement shown in FIG. 4 a flexible sealing strip 32 is engaged in the recess 7A in the shoulder portion 7 of the frame and the double-glazed unit 8 is placed in position and butted-up to the sealing strip. The glazing beads 12 are then fitted by engaging the grooves 28 with the hooked formations 29 and pressing the inner regions of the beads towards the adjacent body portion of the frame, that is downwards as viewed in FIG. 4, this causes the ribs 25A, 25B to flex apart to clear the head of the retaining member 27 and then spring towards one another to engage beneath the head and lock the bead to the frame.

Once fitted the glazing beads cannot be removed without breaking the glass. Movement parallel to the glass, that is upwards in the case of the lower glazing bead shown in FIG. 4, is resisted by the engagement of the hooks 26A, 26B with the retaining members 27. Inward movement of the beads towards the glass, while tending to disengage the hooks 26A from the members 27 and the grooves 28 from the formations 29, urges the hooks 26B more firmly into engagement with the members 27. Outward movement of the beads tends to disengage the hooks 26B from the members 27 but increase the extent of engagement of the hooks 26A and the grooves 28. Thus the formations 25A and 25B are oppositely acting and one becomes more firmly engaged with the frame when attempts are made to disengage the other. Hence removal of the beads can only be effected by breaking the glass.

The arrangements described enable a window system to be glazed from the outside using preformed glazing beads but avoid any security danger by preventing removal of the glazing beads other than by breaking the glass.

Various modifications may be made without departing from the invention. For example the glazing beads may be retained at the edges adjacent to the glass only although retention at both of the regions adjacent to the frame is preferred for greater security. Although a double glazed window system is described and illustrated the invention may also be applied to window systems glazed by means of a single pane of glass. The construction of the glazing beads and the manner in which they co-operate with the window frame may also be altered provided the outer glazing bead cannot be removed other than by breaking the glass. Moreover although primarily intended for use in glazing from the outside the invention could, if desired, be used with the glazing beads located at the inside of the frame.

We claim:

1. A window construction incorporating a pane or panes of glass retained in a frame by elongated glazing beads inserted between the glass and the frame at the outside of the window, each glazing bead comprising first retaining means at or adjacent its outer edge engageable with a co-operating retaining member on the frame and second retaining means at or adjacent its inner edge, said second retaining means comprising oppositely acting retaining formations engageable with at least one co-operating retaining member on the frame, each retaining formation being arranged to be more firmly engaged by movement of the associated bead in a direction to disengage the other formation.

2. A window construction according to claim 1 wherein said retaining formations comprise hooked projections adapted for engagement with complimentary formations on said retaining member.

3. A window construction according to claim 2 wherein said projections are carried by spaced parallel ribs formed on said glazing bead, the projections being directed towards one another and being adapted to engage with a retaining member of T-shaped cross-section carried by said frame.

4. A window construction according to claim 3 wherein said glazing beads are constructed from plastics material and of the same uniform cross-section throughout their lengths.

5. A window construction according to claim 4 including flexible sealing strips interposed between the outer face of said glass and said glazing bead and between the inner face of said glass and a fixed abutment on said frame.

6. A window construction according to claim 5 wherein said flexible sealing strips are engaged in longitudinal recesses formed in said glazing bead and in said abutment.

7. A window construction according to claim 3 wherein said glass is a double-glazing unit comprising inner and outer glass panes spaced from one another and sealed together around their edges.

* * * * *